US007897268B2

(12) United States Patent
Iwasawa et al.

(10) Patent No.: US 7,897,268 B2
(45) Date of Patent: Mar. 1, 2011

(54) COMPOSITE STRUCTURE

(75) Inventors: Junichi Iwasawa, Fukuoka (JP); Ryoichi Nishimizu, Fukuoka (JP); Hironori Hatono, Fukuoka (JP); Hiroaki Ashizawa, Fukuoka (JP)

(73) Assignee: Toto Ltd., Fukuoka (JP)

( * ) Notice: Subject to any disclaimer, the term of this patent is extended or adjusted under 35 U.S.C. 154(b) by 181 days.

(21) Appl. No.: 12/083,065

(22) PCT Filed: Oct. 10, 2006

(86) PCT No.: PCT/JP2006/320203

§ 371 (c)(1), (2), (4) Date: Apr. 3, 2008

(87) PCT Pub. No.: WO2007/043520

PCT Pub. Date: Apr. 19, 2007

(65) Prior Publication Data

US 2009/0233126 A1 Sep. 17, 2009

(30) Foreign Application Priority Data

Oct. 12, 2005 (JP) ..... 2005-298223
Oct. 6, 2006 (JP) ..... 2006-274848

(51) Int. Cl.
*B32B 9/00* (2006.01)

(52) U.S. Cl. ..... 428/688

(58) Field of Classification Search ..... 428/403
See application file for complete search history.

(56) References Cited

U.S. PATENT DOCUMENTS

| | | | | |
|---|---|---|---|---|
| 7,153,567 | B1 * | 12/2006 | Akedo et al. | 428/323 |
| 7,553,376 | B2 * | 6/2009 | Akedo et al. | 118/308 |
| 7,589,038 | B2 * | 9/2009 | Goto et al. | 501/5 |

FOREIGN PATENT DOCUMENTS

| | | | |
|---|---|---|---|
| JP | 10-078630 | | 3/1998 |
| JP | 3265481 | | 1/2002 |
| JP | 2004-075430 | | 3/2004 |
| JP | 2005-158933 | | 6/2005 |
| JP | 2005-217349 | * | 8/2005 |
| JP | 2005-217350 | | 8/2005 |
| JP | 2005-217351 | * | 8/2005 |

* cited by examiner

*Primary Examiner* — Sheeba Ahmed
(74) *Attorney, Agent, or Firm* — Carrier Blackman & Associates, P.C.; Joseph P. Carrier; William D. Blackman

(57) ABSTRACT

According to the present invention, a structure made of yttrium oxide is formed on a surface of a substrate comprises yttrium oxide polycrystals as a main component, a boundary layer made of hyaline does not substantially exist on a boundary face between crystals which form the structure, and both a cubic system and a monoclinic system exist in the crystal system of the yttrium oxide polycrystals. With this, it is possible to adjust the hardness of the structure made of yttrium oxide formed on a surface of a substrate to be larger than that of an yttrium oxide sintered body.

8 Claims, 6 Drawing Sheets

250 nm

COMPOSITE STRUCTURE

CROSS-REFERENCE TO RELATED APPLICATIONS

The present application is a U.S. National phase of, and claims priority based on PCT/JP2006/320203, filed 10 Oct. 2006, which, in turn, claims priority from Japanese patent application 2005-298223, filed 12 Oct. 2005 and from Japanese patent application 2006-274848, filed 06 Oct. 2006. The entire disclosure of each of the referenced priority documents is incorporated herein by reference.

TECHNICAL FIELD

The present invention relates to a composite structure in which a structure made of yttrium oxide is formed on a surface of a substrate.

BACKGROUND ART

There is known a method called an aerosol deposition method in which a structure made of a brittle material is formed on a surface of a substrate without undergoing a heating process. In this aerosol deposition method, aerosol, in which fine particles of a brittle material are dispersed in gas, is ejected from a nozzle toward a substrate such as metal, glass or ceramic so as to cause the fine particles to collide with the substrate. The fine particles of a brittle material are deformed or fractured by the impact of the collision so that the fine particles are joined with each other, and a structure made of the material of the fine particles is directly formed on the substrate. In particular, according to this method, it is possible to form such a structure at normal temperature without a heating means. Since the film structure formed by the aerosol deposition method has similar compactness to a sintered structure, which means that a film structure having high density and high strength can be provided (Patent Document 1).

Also, Patent Documents 2-5 describe a structure of yttrium oxide formed by an aerosol deposition method.

Patent Document 1: Japanese Patent No. 3265481

Patent Document 2: Japanese. Patent Application Publication No. 2005-158933

Patent Document 3: Japanese Patent Application Publication No. 2005-217349

Patent Document 4: Japanese Patent Application Publication No. 2005-217350

Patent Document 5: Japanese Patent Application Publication No. 2005-217351

Summary of the Invention

An object of the present invention is to improve the mechanical strength of a structure made of yttrium oxide formed on a surface of a substrate.

In order to achieve the object, according to the present invention, a structure made of yttrium oxide formed on a surface of a substrate comprises yttrium oxide polycrystals as a main component, a boundary layer made of hyaline does not substantially exist on a boundary face between crystals which form the structure, and both a cubic system and a monoclinic system exist in the crystal system of the yttrium oxide polycrystals, so that the hardness of the structure of yttrium oxide formed on the surface of the substrate can be adjusted to be greater than the hardness of sintered yttrium oxide.

Also, according to a preferred embodiment of the present invention, part of the composite structure of yttrium oxide formed on the surface of the substrate becomes an anchor section biting the surface of the substrate, which allows the composite structure to directly join to the surface of the substrate, so that the joining between the substrate and the composite structure can be strengthened.

Figure 1:
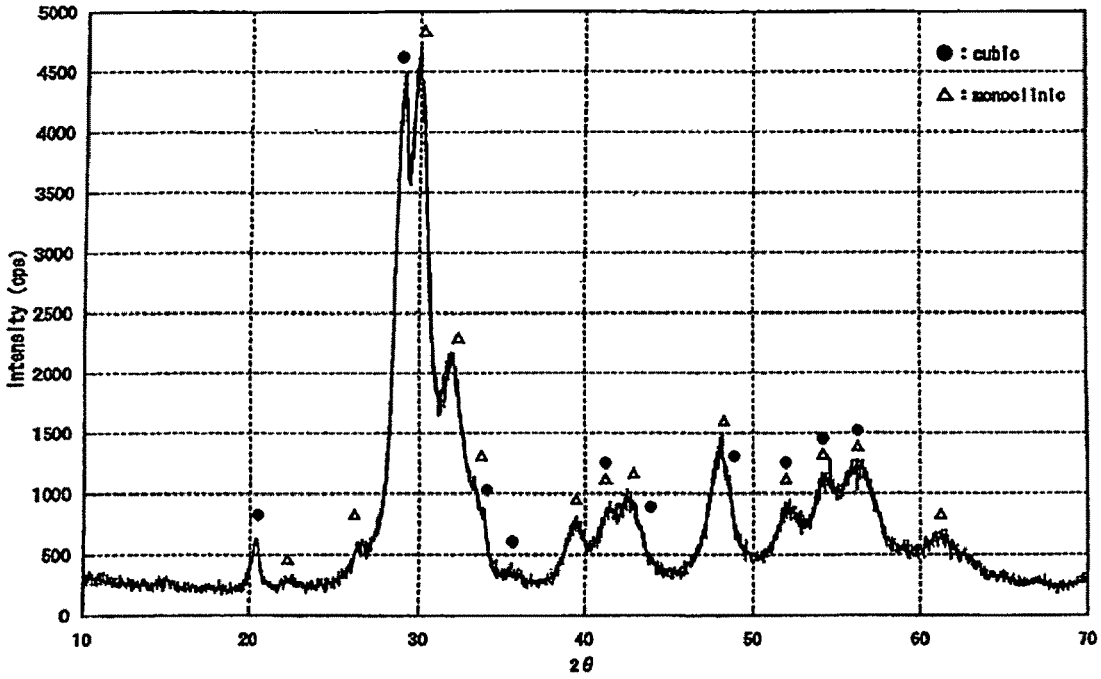
FIG. 1 shows an X-ray diffraction pattern of a structure made of yttrium oxide formed by using mixed powder of aluminum oxide fine particles and yttrium oxide fine particles at a number ratio of 1:100 according to the present invention.

Detailed Description Including Best Mode for Carrying Out the Invention

The technical terms used in the present specification will be explained.

Crystal System

In the present invention, this term refers to a crystal system which is measured by an X-ray diffraction method or an electron diffraction method, and identified based on JCPDS (ASTM) data.

Polycrystal

In the present invention, this term refers to a structure body which is formed by joining and aggregating crystallites. A single crystallite substantially constitutes a crystal, whose diameter is normally 5 nm or more. Although there is a rare case where fine particles are incorporated into the structure body without undergoing fracture, the structure body can be regarded as substantially polycrystalline.

Boundary Face

In the present invention, this term refers to a region which constitutes a mutual boundary between crystallites.

Boundary Layer

This term refers to a layer having a certain thickness (normally, a few nm to a few μm) which is located in the boundary face or in a grain boundary as referred to for a sintered body. This layer normally has an amorphous structure different from a crystal structure found in a crystal particle, and is accompanied by impurity segregation in some cases.

Anchor Section

In the present invention, this term refers to irregularities formed on the interface between a substrate and a brittle material structure. In particular, this term refers to irregularities formed by affecting the surface accuracy of the substrate at the time of forming the brittle material structure instead of forming irregularities on the substrate in advance.

Fine Particle

In the present invention, this term refers to particles whose average diameter is 10 gm or less as identified by granular variation measurement or a scanning electron microscope in a case where primary particles are dense. However, in a case where primary particles are porous and are easy to fracture by impact, this term refers to particles whose average diameter is 50 gm or less. Powder refers to a state where these fine particles naturally aggregate.

Aerosol

In the present invention, this term refers to one in which the above-mentioned fine particles are dispersed in gas such as helium, nitrogen, argon, oxygen, dried air, or mixed gas thereof. Although it is preferred that primary particles are dispersed, an aggregate of primary particles is normally contained. The gas pressure and the temperature are arbitrary. However, it is preferred that the concentration of the fine particles in the gas is in a range of 0.0003 mL/L-10 mL/L at the time of being ejected from a nozzle in a case where it is converted with respect to the gas pressure of one atmosphere and the temperature of 20° C.

Normal Temperature

In the present invention, this term refers to a significantly low temperature compared to the temperature for sintering yttrium oxide. This is substantially a room temperature atmosphere of 0-100° C.

Main Component

In the present invention, this term means that yttrium oxide is the greatest component. Preferably, yttrium oxide is 90 wt % or more.

Average Crystallite Size

In the present invention, this term refers to a crystallite size which is calculated by the Scherrer method of an X-ray diffraction method, and is measured and calculated by means of MXP-18 manufactured by MacScience Co. It is also possible to use a value which is calculated by measuring a crystallite size directly from a TEM (transmission electron microscope) image.

Compactness

In the present invention, this term refers to a percentage (%) of a value which is calculated by bulk specific gravity/true specific gravity, where the true specific gravity is calculated based on the literature value taking the structural ratio of the film components into account.

Substrate

In the present invention, the substrate is not limited if it is made of a material having sufficient rigidity to generate mechanical impact for fracturing or deforming the ingredient of fine particles when aerosol is ejected onto the substrate so as to cause the fine particles to collide with the substrate. Preferred examples of the substrate include glass, metal, ceramic, an organic compound, and a composite material thereof.

Next, preferred embodiments according to the present invention will be explained. First, a method for forming a structure made of yttrium oxide on a substrate will be explained with reference to FIG. 4.

Figure 4:
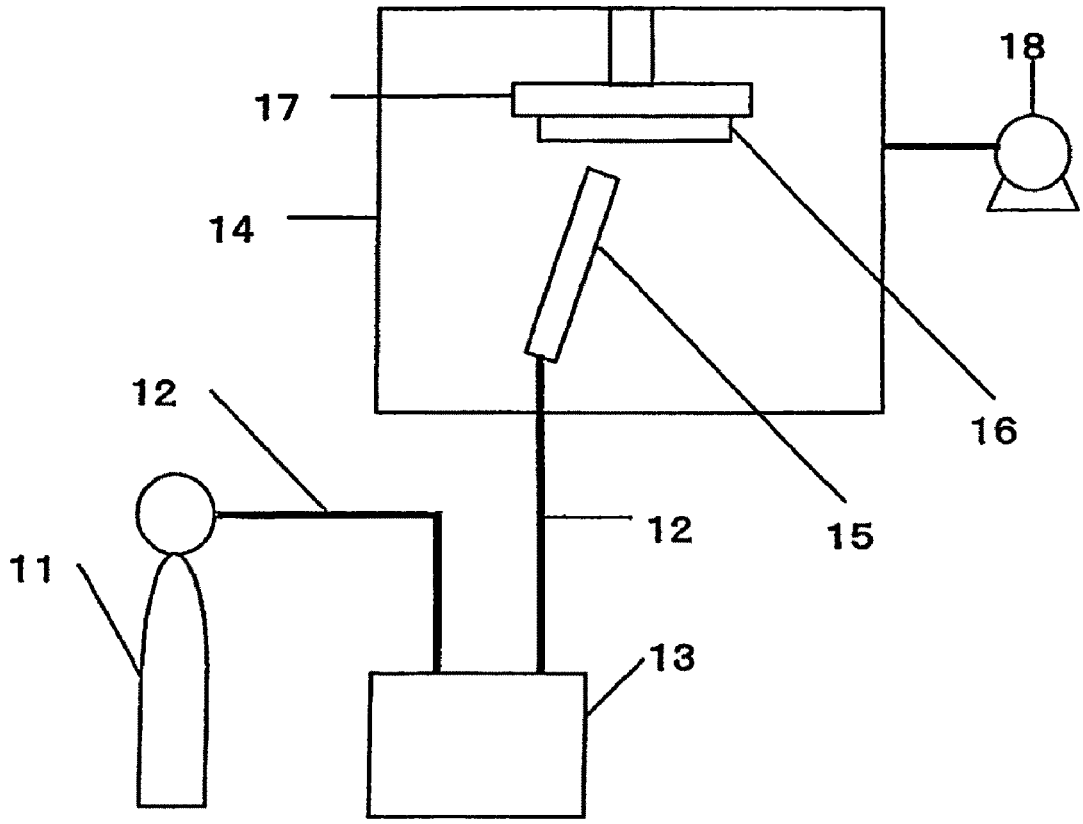
FIG. 4 is a schematic diagram of an apparatus for forming a structure made of yttrium oxide according to the present invention.

FIG. 4 is a schematic diagram of an apparatus for forming a structure made of yttrium oxide on a substrate. A gas tank 11 is connected to an aerosol generator 13 via a carrier pipe 12, and a nozzle 15 is provided within a forming chamber 14 via the carrier pipe 12. A substrate 16 mounted on an XY stage 17 is provided above the nozzle 15 so as to be opposed to the nozzle 15 at a distance of 10 mm. The forming chamber 14 is connected to an exhaust pump 18.

In operation, after ingredient powder is filled in the aerosol generator 13, the gas tank 11 is opened, and gas is introduced to the aerosol generator 13 via the carrier pipe 12, so as to generate aerosol in which ingredient powder is dispersed in gas. The aerosol is sent toward the forming chamber 14 via the carrier pipe 12, and the ingredient powder is ejected from the nozzle 15 toward the substrate 16 while accelerated to a high speed.

A more preferred method for forming a structure made of yttrium oxide on a substrate will be explained.

The gas filled in the gas tank 11 may be helium, nitrogen, argon, oxygen, dried air, or mixed gas thereof. However, helium or nitrogen is used in the more preferred method.

Also, as the ingredient powder contained in the aerosol generator 13, yttrium oxide particles having an average diameter of sub μm order and aluminum oxide particles having an average diameter of μm order are used in the more preferred method.

In the crystal system of the structure made of yttrium oxide formed by using the above-described apparatus, the intensity ratio of the strongest line of the monoclinic system with respect to the strongest line of the cubic system in the X-ray diffraction is preferably 0.5 or more, more preferably 0.8 or more, and furthermore preferably 1.0 or more. With this, the Vickers hardness can be significantly improved. The intensity of the strongest line refers to the intensity of the peak height of the strongest line.

The average crystallite size of the structure made of yttrium oxide formed by using the above-described apparatus is preferably 10-70 nm, more preferably 10-50 nm, and furthermore preferably 10-30 nm.

The compactness of the structure made of yttrium oxide formed by using the above-described apparatus is preferably 90% or more, more preferably 95% or more, and furthermore preferably 99% or more.

The structure made of yttrium oxide formed by using the above-described apparatus can be used as a member for a semiconductor or liquid crystal manufacturing apparatus which is exposed to a plasma atmosphere such as a chamber, a bell jar, a susceptor, a clamp ring, a focus ring, a capture ring, a shadow ring, an insulating ring, a dummy wafer, a tube for generating high-frequency plasma, a dome for generating high-frequency plasma, a high-frequency transmitting window, a infrared transmitting window, a monitor window, an end point monitor, a lift pin for supporting a semiconductor wafer, a shower plate, a baffle plate, a bellows cover, an upper electrode or a lower electrode.

As a substrate of the member for a semiconductor or liquid crystal manufacturing apparatus, it is possible to use metal, ceramic, semiconductor, glass, quartz, resin or the like.

Also, the structure made of yttrium oxide according to the present invention can be used as an electrostatic chuck for an etching apparatus etc. which performs fine processing to a semiconductor wafer or a quartz wafer.

Also, the structure made of yttrium oxide according to the present invention can be used as an insulating film, an anti-abrasion film, a dielectric film, a radiation film, or a heat-resistant coating film.

Next, preferred embodiments according to the present invention will be explained with reference to an example.

In the present example, a mixed powder of yttrium oxide fine particles and aluminum oxide fine particles having a larger diameter than that of the yttrium oxide fine particles was used as ingredient powder for forming a structure made of yttrium oxide.

EXAMPLE

Yttrium oxide fine particles and aluminum oxide fine particles were prepared. The 50% average diameter with respect to the volume of the aluminum oxide fine particles was 5.9 μm, and the average diameter of the yttrium oxide fine particles was 0.47 μm. Incidentally, the 50% average diameter with respect to the volume refers to a particle diameter where the accumulated volume of particles having a smaller diameter reaches 50% in particle size distribution data measured by using a laser diffraction particle size analyzer. The average particle diameter of the yttrium oxide fine particles was calculated from the specific surface measured by Fisher sub-sieve sizer.

Next, mixed powder was prepared by mixing these particles at a number ratio where aluminum oxide fine particle: yttrium oxide fine particle=1:100.

Also, aluminum oxide fine particles having a 50% average diameter with respect to the volume of 2.1 μm and yttrium oxide fine particles having an average diameter of 0.47 μm were prepared. These particles were mixed at a number ratio where aluminum oxide fine particle:yttrium oxide fine particle=1:10.

The aluminum oxide fine particles function as assisting particles for forming a film, and specifically cause the yttrium oxide fine particles to be deformed or fractured so as to generate a new surface. The aluminum oxide fine particles bounce after collision, so that they do not directly constitute the layer structure unless they are incorporated therein accidentally. Therefore, the material is not limited to aluminum oxide, and yttrium oxide may be used. However, aluminum oxide is most preferable in terms of cost.

The above-described mixed powder was filled in the aerosol generator of the apparatus shown in FIG. 4, and nitrogen gas was allowed to flow in the apparatus at a flow rate of 5 liter/minute as carrier gas, so that aerosol is generated and ejected onto an aluminum alloy substrate. The opening of the nozzle was 0.4 mm in height and 20 mm in width. The pressure inside the structure forming apparatus was adjusted to be 90-120 kPa when the structure was formed. In this way, the structure made of yttrium oxide was formed on the substrate, in which the height of the structure was 25 μm and the area of the structure was 20 mm×20 mm.

Figure 2:
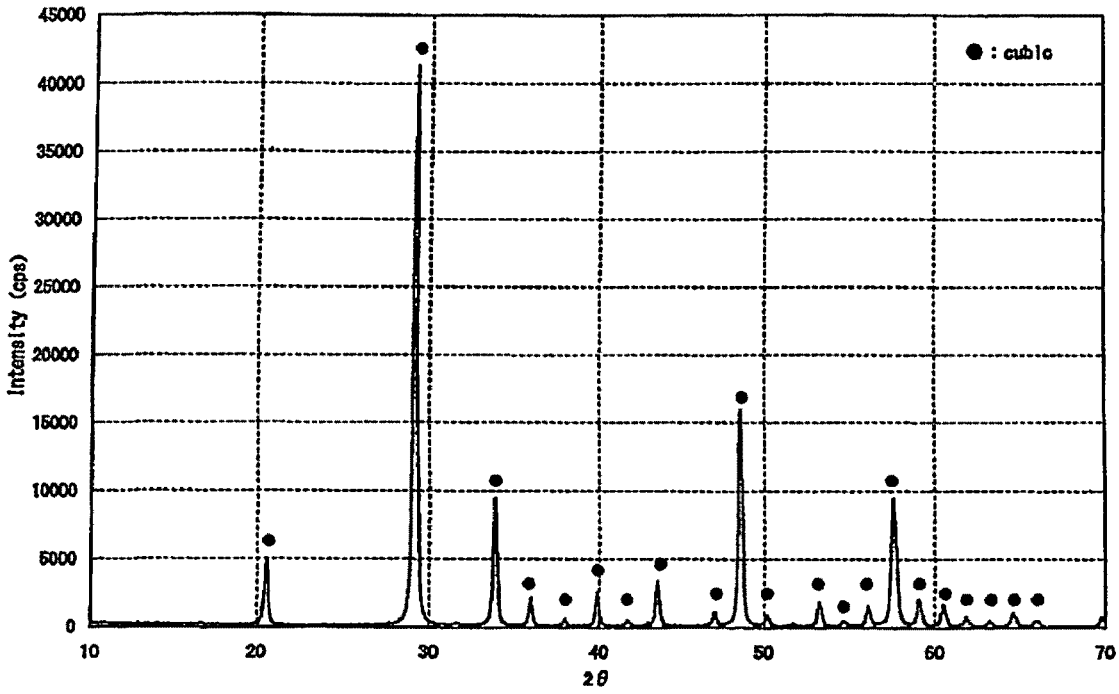
FIG. 2 shows an X-ray diffraction pattern of yttrium oxide fine particles as ingredient powder used for forming the structure made of yttrium oxide according to the present invention.
Figure 3:
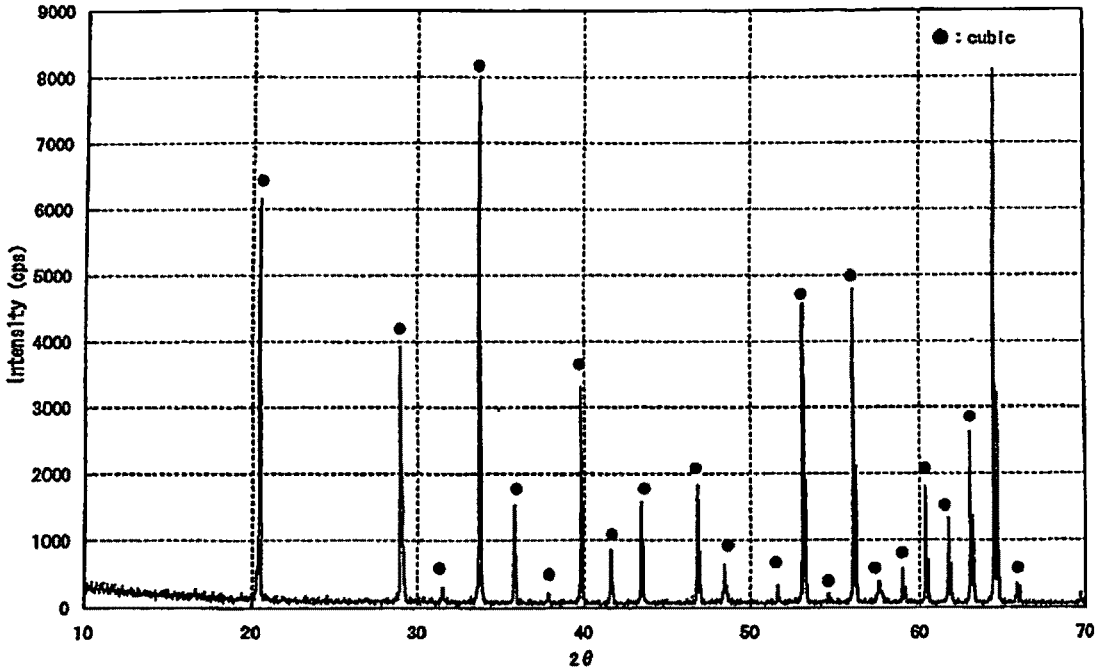
FIG. 3 shows an X-ray diffraction pattern of a yttrium oxide sintered body (processed by HIP)
Figure 5:
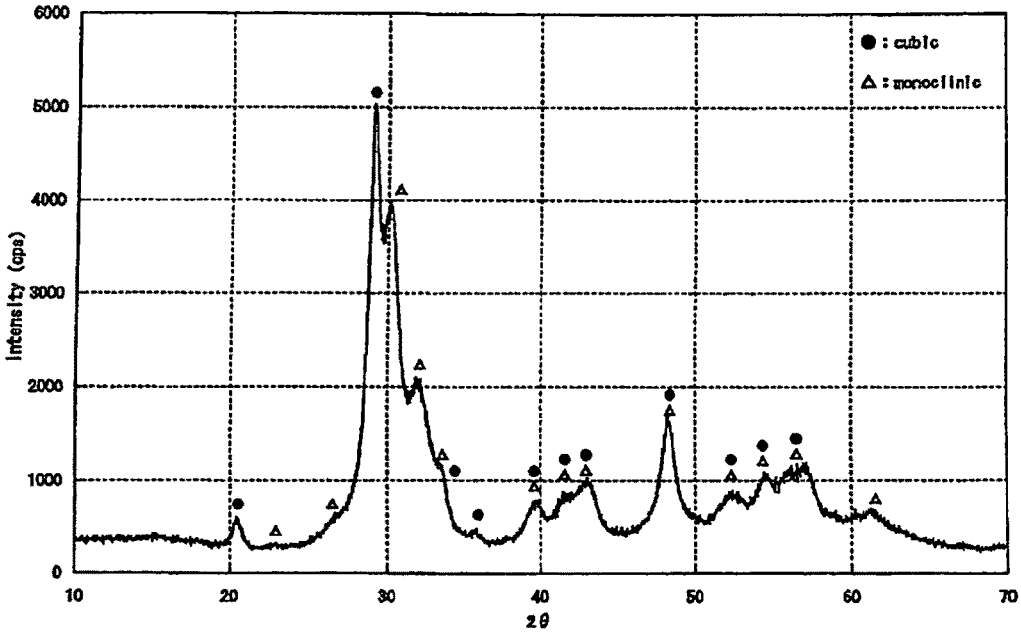
FIG. 5 shows an X-ray diffraction pattern of a structure made of yttrium oxide formed by using mixed powder of aluminum oxide fine particles and yttrium oxide fine particles at a number ratio of 1:10 according to the present invention.

FIG. 1 shows an X-ray diffraction pattern of a structure made of yttrium oxide formed by using mixed powder of aluminum oxide fine particles and yttrium oxide fine particles at a number ratio of 1:100 according to the present invention. FIG. 5 shows an X-ray diffraction pattern of a structure made of yttrium oxide formed by using mixed powder of aluminum oxide fine particles and yttrium oxide fine particles at a number ratio of 1:10 according to the present invention. FIG. 2 shows an X-ray diffraction pattern of yttrium oxide fine particles as ingredient powder used for forming the structure made of yttrium oxide according to the present invention. FIG. 3 shows an X-ray diffraction pattern of an yttrium oxide sintered body (processed by HIP).

The crystal system of the structure made of yttrium oxide formed by the above-described method was cubic or monoclinic. In contrast, the crystal system of the ingredient powder and the yttrium oxide sintered body was cubic only.

In FIG. 1, the intensity ratio of the strongest line of the cubic system and the strongest line of the monoclinic system was 1.04 based on the strongest peak intensity of the cubic system observed in around 2θ=29° and the strongest peak intensity of the monoclinic system observed in around 2θ=30°.

In FIG. 5, the intensity ratio of the strongest line of the cubic system and the strongest line of the monoclinic system was 0.80 based on the strongest peak intensity of the cubic system observed in around 2θ=29° and the strongest peak intensity of the monoclinic system observed in around 2θ=30°.

Table 1 shows the measurement results of the Vickers hardness of the above samples. The Vickers hardness was measured with test force of 50 gf by using a dynamic ultra micro hardness tester (DUH-W201 manufactured by SHIMADZU CORPORATION). The hardness of the structure made of yttrium oxide according to the present invention in which both the cubic system and the monoclinic system exist was greater than that of the yttrium oxide sintered body constructed of the cubic system alone.

TABLE 1

| | Structure of yttrium oxide (Mixture ratio 1:100) | Structure of yttrium oxide (Mixture ratio 1:10) | Yttrium oxide sintered body |
|---|---|---|---|
| Crystal system | Cubic + Monoclinic | Cubic + Monoclinic | Cubic |
| Strongest peak intensity of monoclinic system/ Strongest peak intensity of cubic system | 1.04 | 0.80 | 0.00 |
| Vickers hardness (GPa) | 9.2 | 7.8 | 6.7 |

The adhesion strength of the structure comprising yttrium oxide polycrystals formed by the present invention was measured as follows:

A cylindrical rod made of stainless was cured with epoxy resin on the surface of the structure comprising yttrium oxide polycrystals at 120° C. for 1 hour, and the cylindrical rod was inclined in a direction of 90° by using a desktop small testing machine (EZ Graph manufactured by SHIMADZU CORPORATION). The adhesion strength F was calculated from the following equation:

$$F=(4/\pi r^3)\times h\times f$$

where r is the radius of the cylindrical rod, h is the height of the cylindrical rod, and f is the test force when peeling occurs.

The adhesion strength of the structure comprising yttrium oxide polycrystals formed on the aluminum alloy substrate according to the present invention was 80 MPa or more, and it can be said that the adhesion strength was excellent.

Figure 6:
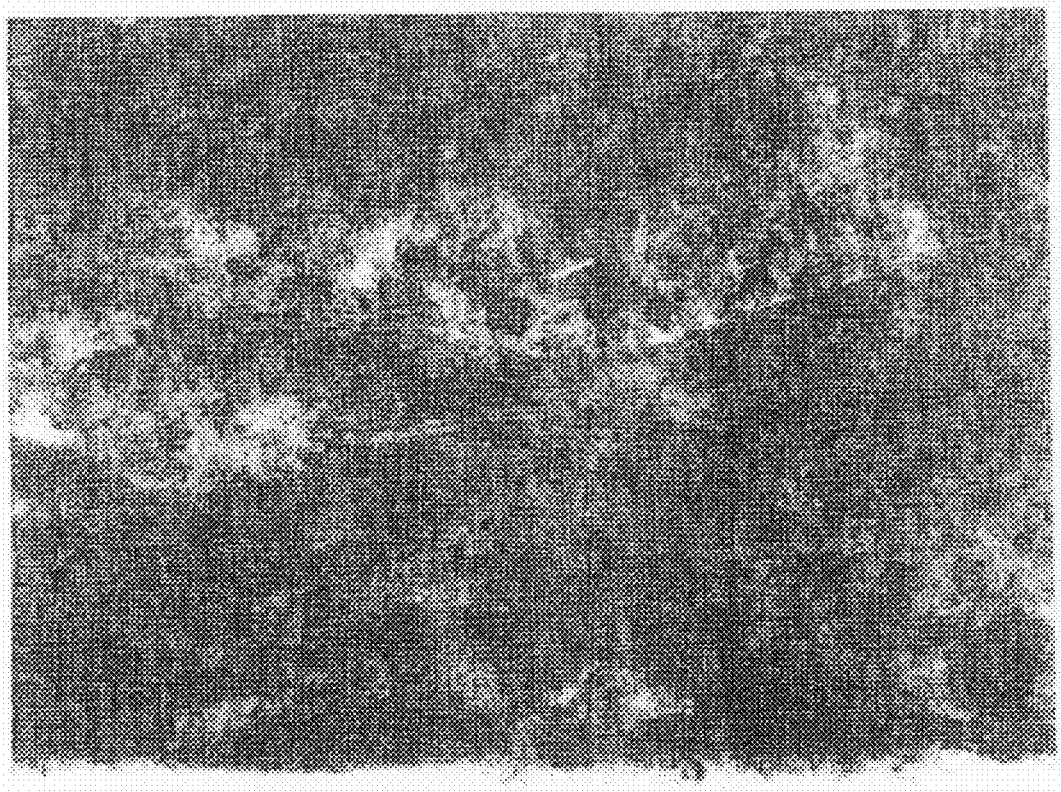
FIG. 6 shows a TEM photograph of a cross section of a structure comprising yttrium oxide polycrystals according to the present invention.

FIG. 6 shows a TEM photograph of a cross section of the structure comprising yttrium oxide polycrystals according to the present invention. It shows that part of the structure comprising yttrium oxide polycrystals becomes an anchor portion biting the surface of the quartz glass substrate.

As mentioned above, according to the present invention, it is possible to improve the mechanical strength of the structure made of yttrium oxide formed on a surface of a substrate.

Although there have been described what are the present embodiments of the invention, it will be understood that variations and modifications may be made thereto within the scope of the claims appended hereto.

The invention claimed is:

1. A composite structure made of yttrium oxide formed on a surface of a substrate by aerosol deposition comprising yttrium oxide polycrystals as a main component, wherein substantially no amorphous structure exists on a boundary face between crystals which form the structure, and both a cubic system and a monoclinic system exist in the crystal system of the yttrium oxide polycrystals, and wherein the composite structure is formed by generating an aerosol containing a mixed powder of yttrium oxide fine particles and assisting particles having a larger diameter than that of the yttrium oxide fine particles, and ejecting the aerosol from a nozzle so that the yttrium oxide fine particles and the assisting particles impact against the substrate surface at high speed, wherein the assisting particles cause the yttrium oxide particles to be deformed or fractured so as to form the composite structure made of yttrium oxide on the substrate surface, but the assisting particles bounce back after impacting the substrate surface so that assisting particles do not constitute the composite structure unless they are incorporated therein accidentally.

2. The composite structure according to claim 1, wherein the yttrium oxide fine particles have an average diameter of sub micron order and the assisting particles have an average diameter of micron order.

3. The composite structure according to claim 1, wherein a mixture ratio of the assisting particles to the yttrium oxide fine particles in the mixed powder is in a range of 1:10 to 1:100.

4. The composite structure according to claim 1, wherein the assisting particles are aluminum oxide particles.

5. A composite structure made of yttrium oxide formed on a surface of a substrate by aerosol deposition comprising yttrium oxide polycrystals as a main component, wherein substantially no amorphous structure exists on a boundary face between crystals which form the structure, and both a cubic system and a monoclinic system exist in the crystal system of the yttrium oxide polycrystals.

6. The composite structure according to claim 5, wherein the composite structure has a compactness of at least 90%.

7. The composite structure according to claim 5, wherein an average size of crystallites in the composite structure is 10-70 μm.

8. The composite structure according to claim 5, wherein a Vickers hardness of the composite structure is at least 7.0 GPa.

* * * * *